US012122480B2

(12) United States Patent
Mao et al.

(10) Patent No.: US 12,122,480 B2
(45) Date of Patent: Oct. 22, 2024

(54) ANTI-ROLLING DAMPING DEVICE FOR FLOATING WIND TURBINES

(71) Applicant: GUANGDONG OCEAN UNIVERSITY, Zhanjiang (CN)

(72) Inventors: Hongfei Mao, Zhanjiang (CN); Zhongbing Zhou, Zhanjiang (CN); Guanglin Wu, Zhanjiang (CN); Yingchao Ma, Zhanjiang (CN); Yanli He, Zhanjiang (CN); Zhenglin Tian, Zhanjiang (CN); Jinbo Lin, Zhanjiang (CN); Hui Yang, Zhanjiang (CN); Dongbin He, Zhanjiang (CN); Weijiang Zheng, Zhanjiang (CN); Jinwen Zeng, Zhanjiang (CN); Long Han, Zhanjiang (CN); Yuanting Yang, Zhanjiang (CN); Junxian Teng, Zhanjiang (CN)

(73) Assignee: GUANGDONG OCEAN UNIVERSITY, Zhanjiang (CN)

( * ) Notice: Subject to any disclaimer, the term of this patent is extended or adjusted under 35 U.S.C. 154(b) by 0 days.

(21) Appl. No.: 18/646,770

(22) Filed: Apr. 26, 2024

(65) Prior Publication Data

US 2024/0294232 A1 Sep. 5, 2024

Related U.S. Application Data

(63) Continuation of application No. PCT/CN2023/140258, filed on Dec. 20, 2023.

(30) Foreign Application Priority Data

Feb. 27, 2023 (CN) ..... 202310180650.8

(51) Int. Cl.
*B63B 1/10* (2006.01)
*B63B 1/14* (2006.01)
(Continued)

(52) U.S. Cl.
CPC ..... *B63B 1/107* (2013.01); *B63B 1/14* (2013.01); *B63B 39/03* (2013.01);
(Continued)

(58) Field of Classification Search
CPC .. B63B 1/00; B63B 1/107; B63B 1/14; B63B 39/00; B63B 39/03
(Continued)

(56) References Cited

FOREIGN PATENT DOCUMENTS

CN 202783720 U 3/2013
CN 108616236 A 10/2018
(Continued)

*Primary Examiner* — Lars A Olson

(57) ABSTRACT

The disclosure belongs to a field of hydraulic equipment, and in particular to an anti-rolling damping device for floating wind turbines. The specific technical scheme: low ends of buoys are connected with an upper surface of a support plate through a damping assembly, and the damping assembly includes a piston cylinder fixedly arranged on the support plate, a piston plate is slidably arranged in the piston cylinder, a piston rod is arranged at one end of the piston plate far from the support plate, the piston rod extends out of the piston cylinder and is fixedly connected with the buoys, and a plurality of first through holes are arranged on a side wall of the piston cylinder near the lower part. The buoys sink with waves, and the piston plate slides downwards in the piston cylinder.

10 Claims, 8 Drawing Sheets

(51) Int. Cl.
*B63B 39/03* (2006.01)
*B63B 35/44* (2006.01)

(52) U.S. Cl.
CPC ... *B63B 2001/145* (2013.01); *B63B 2035/442* (2013.01); *B63B 2035/446* (2013.01)

(58) Field of Classification Search
USPC ..... 114/122
See application file for complete search history.

(56) References Cited

FOREIGN PATENT DOCUMENTS

| | | | |
|---|---|---|---|
| CN | 113107748 | A | 7/2021 |
| CN | 113428310 | A | 9/2021 |
| JP | 2022029139 | A | 2/2022 |

ANTI-ROLLING DAMPING DEVICE FOR FLOATING WIND TURBINES

TECHNICAL FIELD

The disclosure belongs to a field of hydraulic equipment, and in particular to an anti-rolling damping device for floating wind turbines.

BACKGROUND

Offshore wind resources are gradually developed, and floating wind turbines are not limited by water depth and can simplify the hoisting of units, thus making it possible to develop wind resources in far-reaching sea areas. The floating wind turbines float on the sea surface, rather than being fixed to the seabed by individual piles or jackets.

Floating foundation structures of the offshore wind turbines include three types: a column-stabilized (semi-submersible) type, a tension leg type and a single column type. Semi-submersible wind turbines are characterized by a wide range of application and easy installation. However, the stability is poor, and in order to maintain stability, semi-submersible wind turbines are generally required to be equipped with dynamic stability systems. Due to the lack of a stable pile foundation, the wind turbine platform has a large motion response under the action of waves and wind, thereby seriously affecting the working efficiency and safety of the wind turbine. How to reduce the motion response of the wind turbine platform under the action of waves and wind is the key technology of the floating wind turbines.

Therefore, it has excellent prospects for industrial application if an anti-rolling damping device with strong stability and good anti-rolling effect for the floating wind turbines is capable of being provided.

SUMMARY

In order to solve the above technical problems, the disclosure provides an anti-rolling damping device for floating wind turbines with strong stability and good anti-rolling effect.

In order to achieve the purpose of the disclosure, the technical scheme adopted by the disclosure is as follows: the anti-rolling damping device for the floating wind turbines includes a support plate and buoys arranged above the support plate, where the buoys are movably connected with a fixed frame for fixing a wind turbine, and a bottom of the fixed frame is fixedly arranged on the support plate; lower ends of the buoys are connected with an upper surface of the support plate through a damping assembly, and the damping assembly includes a piston cylinder fixedly arranged on the support plate, a piston plate is slidably arranged in the piston cylinder; a piston rod is arranged at one end of the piston plate far from the support plate; the piston rod extends out of the piston cylinder and is fixedly connected with the buoys; and a plurality of first through holes are arranged on a side wall of the piston cylinder near a lower part; the buoys sink with waves, and the piston plate slides downwards in the piston cylinder, so that the water in the piston cylinder is discharged through the plurality of first through holes small in size, and resistance of the piston plate sliding downward is increased.

Optionally, a sliding plate is arranged on a side wall of the piston cylinder along a vertical direction, and a steel wire is arranged at an upper end of the sliding plate, and another end of the steel wire is connected with the piston plate by being arranged above the piston plate and above a slider; the buoys float with the waves, the piston plate slides upward in the piston cylinder, the sliding plate slides downward to cover the first through holes, and water is stored below the piston plate and in the piston cylinder, thus increasing the weight of the damping assembly.

Optionally, the side wall of the piston cylinder is provided with a second through hole with a shape of "[" along a height direction, a lower end of the second through hole passes through the first through holes, the sliding plate is slidably arranged in the second through hole, and the steel wire is connected with an upper end face of the piston plate through an upper transverse hole of the second through hole.

Optionally, a fixed plate is arranged in the piston cylinder and above the piston plate, a first cavity is formed below the piston plate and at a bottom of the piston cylinder, a second cavity is formed above the piston plate and below the fixed plate, and a third cavity is formed above the fixed plate and at the top of the piston cylinder; an open end at a top of the second through hole is communicated with the third cavity, a pulley is fixedly arranged in the upper transverse hole of the second through hole, and the steel wire passes through the pulley and passes through the fixed plate to be connected with an upper end face of the piston plate.

Optionally, a telescopic rod is arranged in the piston cylinder and between a lower end of the fixed plate and an upper end of the piston plate, and a first spring is arranged at a periphery of the telescopic rod.

Optionally, limit blocks are arranged on an inner side wall of the piston plate, at upper ends of the first through holes and below the piston plate.

Optionally, a stopper is arranged in a vertical hole of the second through hole near the transverse hole, and the steel wire passes through the vertical hole, the stopper and the transverse hole in turn and is fixedly connected with the upper end face of the piston plate; a plurality of third through holes are arranged on a side wall close to the piston rod and below the stopper in the vertical hole of the second through hole, and the plurality of third through holes are used for communicating the second cavity with the vertical hole of the second through hole; hydraulic oil is filled in the second cavity and the vertical hole of the second through hole.

Optionally, the fixed frame is provided with a third connecting rod corresponding to the buoys; the buoys are hinged with a first connecting rod, and another end of the first connecting rod is hinged with a second connecting rod, and another end of the second connecting rod is slidably arranged on the third connecting rod along the length direction of the third connecting rod.

Optionally, a chute with a shape of "T" is arranged on an outer side wall of the third connecting rod along a length direction, and a corresponding slider with a shape of "T" is slidably arranged in the chute, and the slider is hinged with the second connecting rod.

Optionally, a second spring is arranged in the chute, one end of the second spring is fixedly connected with one end in the chute close to the fixed frame, and another end of the second spring is fixedly connected with the slider.

Compared with the prior art, the disclosure has following beneficial effects:

According to the disclosure, the piston cylinder is arranged on the support plate, the piston plate is slidably arranged in the piston cylinder, the piston plate is connected with the buoy through the piston rod, the first through holes are arranged on the side wall of the lower end of the piston cylinder, the sliding plate is slidably arranged in the side wall of the piston plate, and the upper end of the sliding plate is connected with the upper end of the piston plate through the steel wire. The sliding plate moves downward, thus blocking the first through holes, preventing the water outside the piston cylinder from entering the piston cylinder, isolating the outside from the inside of the piston cylinder through the sliding plate, increasing the counterweight of the piston cylinder, and further reducing the swing amplitude of the buoy. The buoy floats up with the waves, the piston plate slides upward in the piston cylinder, the sliding plate slides downward to block the first through holes due to the own weight, and water is stored below the piston plate and in the piston cylinder, thus increasing the weight of the damping assembly and reducing the upward swing amplitude of the buoy.

Figure 1:
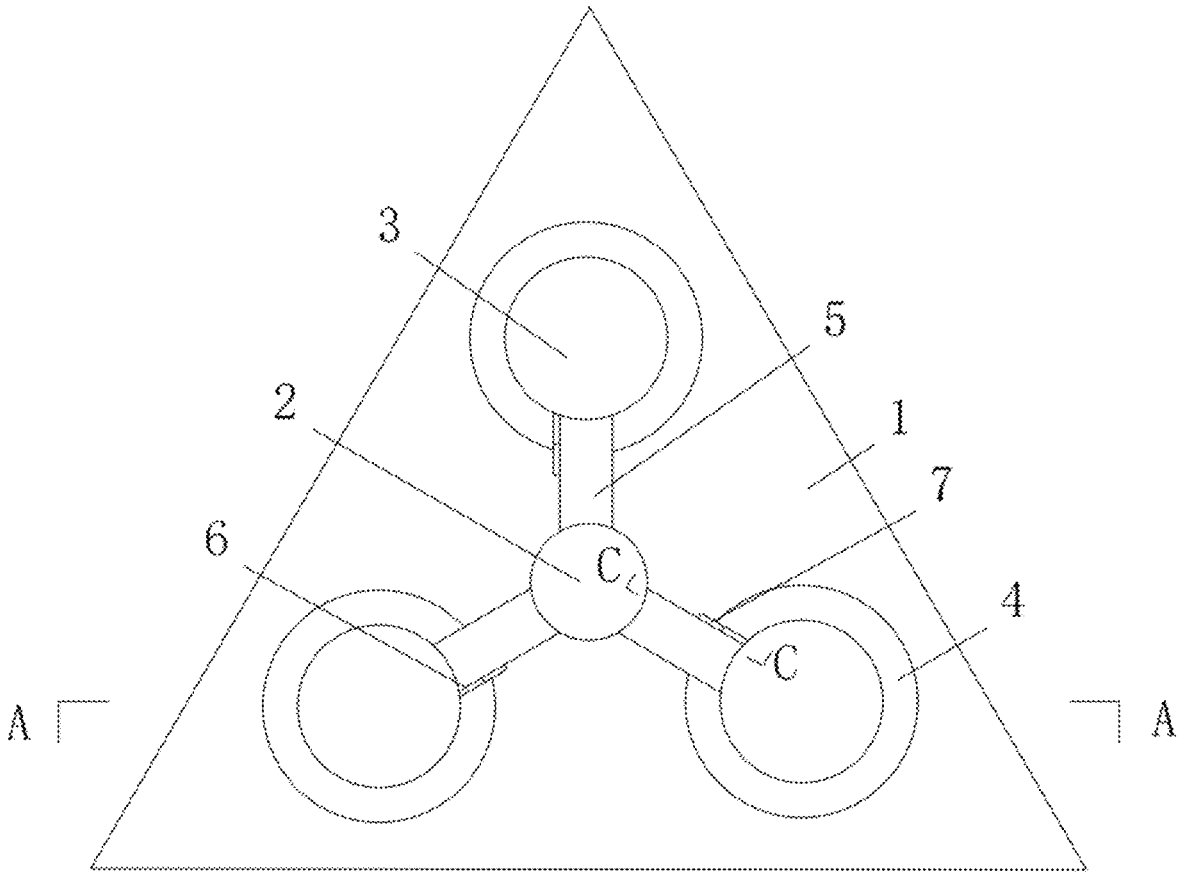
FIG. 1 is a schematic plan view of an overall structure of an anti-rolling damping device according to the present disclosure.
Figure 2:
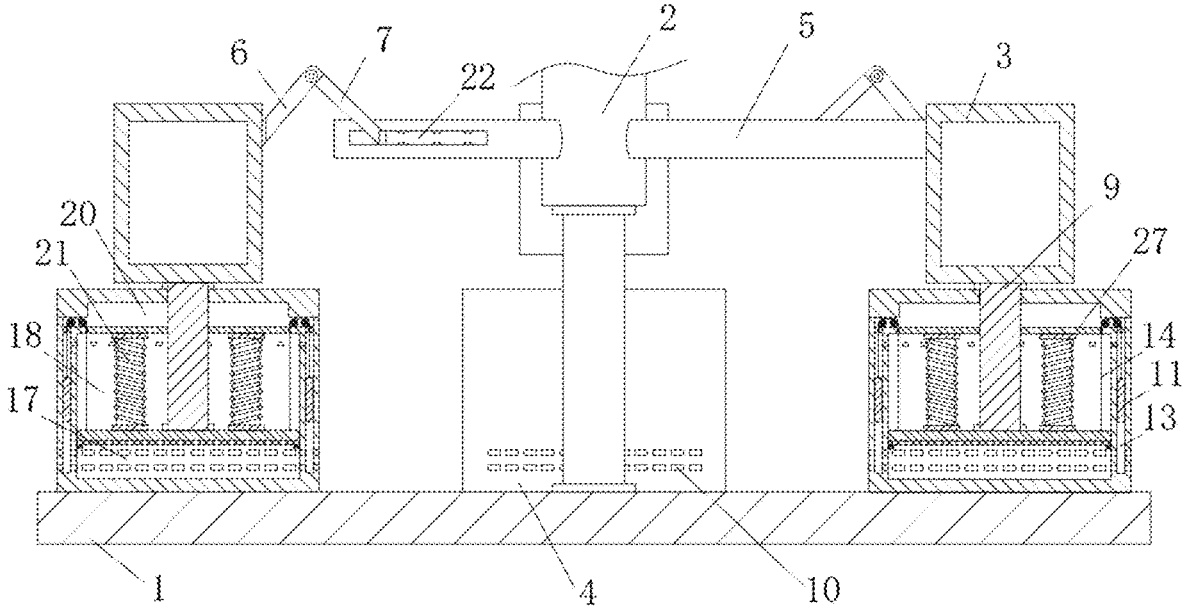
FIG. 2 is a schematic cross-sectional view of a section A-A in FIG. 1.

In figures: support plate 1; fixed frame 2; buoy 3; piston cylinder 4; third connecting rod 5; first connecting rod 6; second connecting rod 7; piston plate 8; piston rod 9; first through hole 10; sliding plate 11; limit block 12; second through hole 13; steel wire 14; third through hole 15; stopper 16; first cavity 17; second cavity 18; pulley 19; third cavity 20; first spring 21; chute 22; slider 23; groove 24; second spring 25; stop block 26; fixed plate 27; telescopic rod 28.

DETAILED DESCRIPTION OF THE EMBODIMENTS

In the following, the technical scheme in the embodiment of the disclosure is clearly and completely described with reference to the figures. Obviously, the described embodiment is only a part of embodiments of the disclosure, but not the whole embodiments. Unless otherwise specified, the technical means used in the embodiment are conventional means well known to those skilled in the art.

In the description of the disclosure, it is to be understood that the orientation or position relationships indicated by the terms "vertical", "horizontal", "up", "down", "front", "back", "left", "right", "longitudinal", "transverse", "top", "bottom", "inside", "outside", etc., are based on the orientation or position relationships shown in the attached drawings and are intended only to facilitate the description of the disclosure. It is not indicated or implied that the device or element referred to must have a particular orientation, be constructed and operated in a particular orientation, and therefore cannot be construed as a limitation of the present disclosure.

As shown in FIGS. 1-8, the disclosure discloses an anti-rolling damping device for floating wind turbines, including a support plate 1 and buoys 3 arranged above the support plate 1, where the buoys 3 are movably connected with a fixed frame 2 for fixing a wind turbine, and a bottom of the fixed frame 2 is fixedly arranged on the support plate 1. As shown in FIG. 1, in order to improve the stability of the fixed frame 2, three buoys 3 are usually arranged around the fixed frame 2, and all three buoys 3 are connected with the fixed frame 2 through connecting rods to form a stable triangular bracket. In the working state, upper ends of the three buoys 3 and an upper end of the fixed frame 2 floats on the sea level, and the support plate 1 completely floats and sinks in the sea. There is a certain distance between the support plate 1 and the buoys 3, and the support plate 1 has a certain mass and volume, thus reducing the influence of sea level waves on the support plate 1 and essentially preventing the support plate 1 from fluctuating with the waves. Since the supporting plate 1 has a certain mass, the counterweight under the fixed frame 2 is added, thus reducing the shaking amplitude of the fixed frame 2 to a certain extent.

Figure 3:
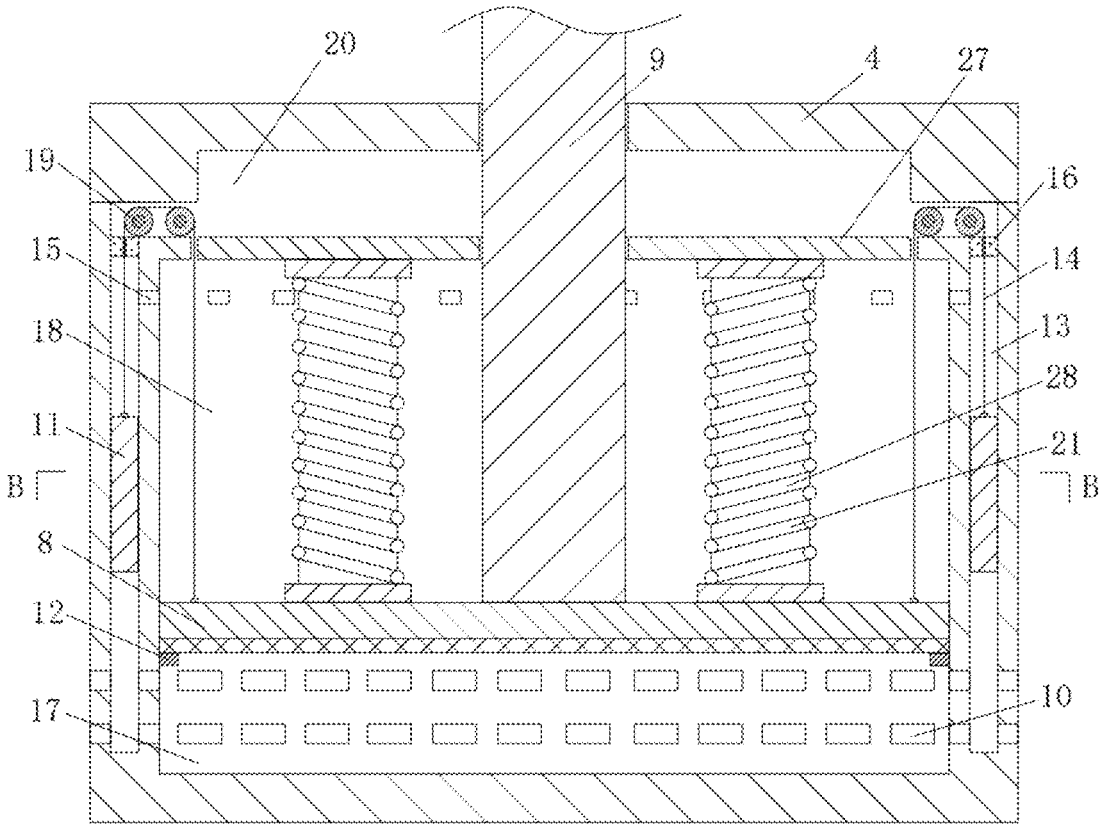
FIG. 3 is a schematic sectional view of an overall structure of a damping assembly according to the present disclosure.
Figure 4:
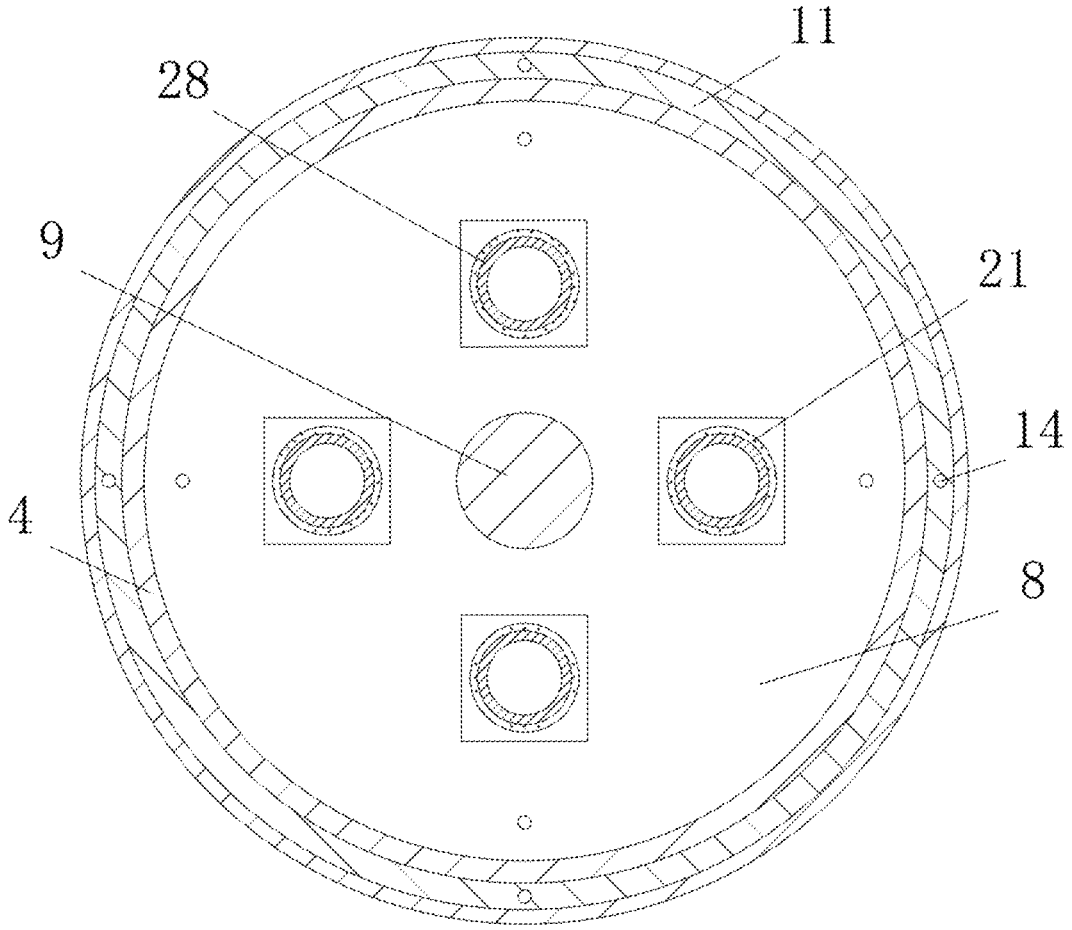
FIG. 4 is a schematic cross-sectional view of a section B-B in FIG. 3.
Figure 5:
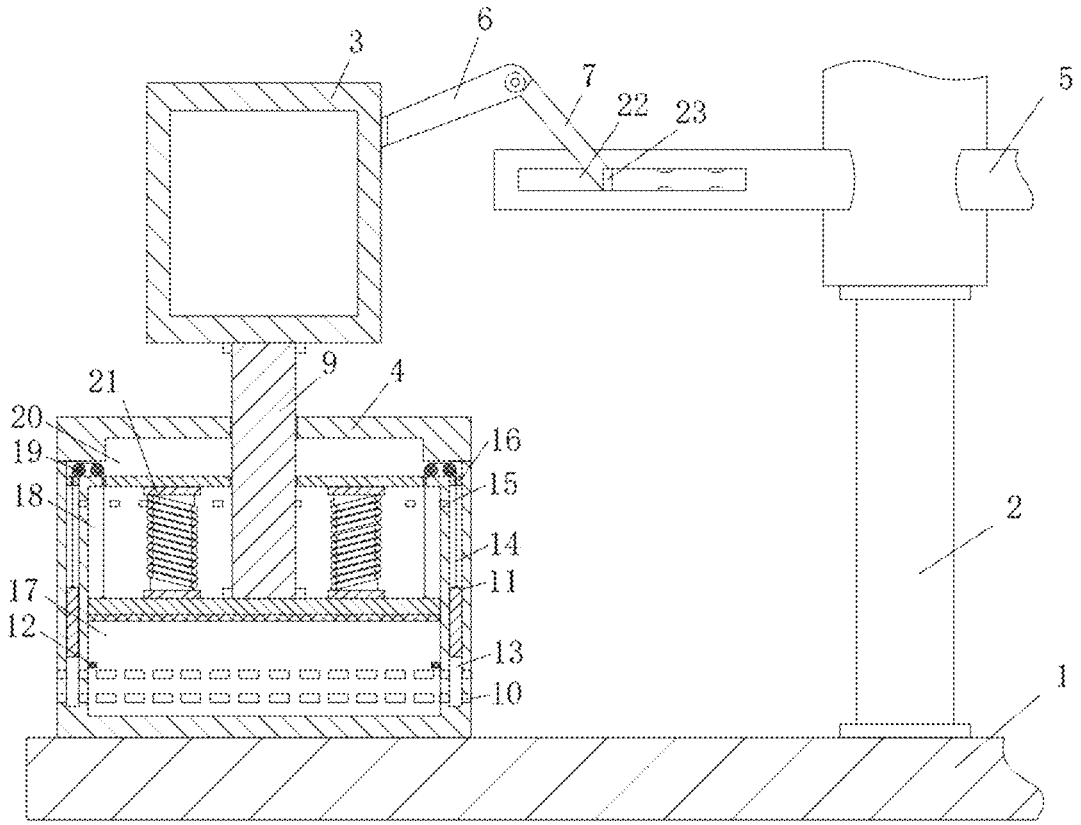
FIG. 5 is a schematic diagram showing a state of the anti-rolling damping device according to the present disclosure when the water surface is still.
Figure 6:
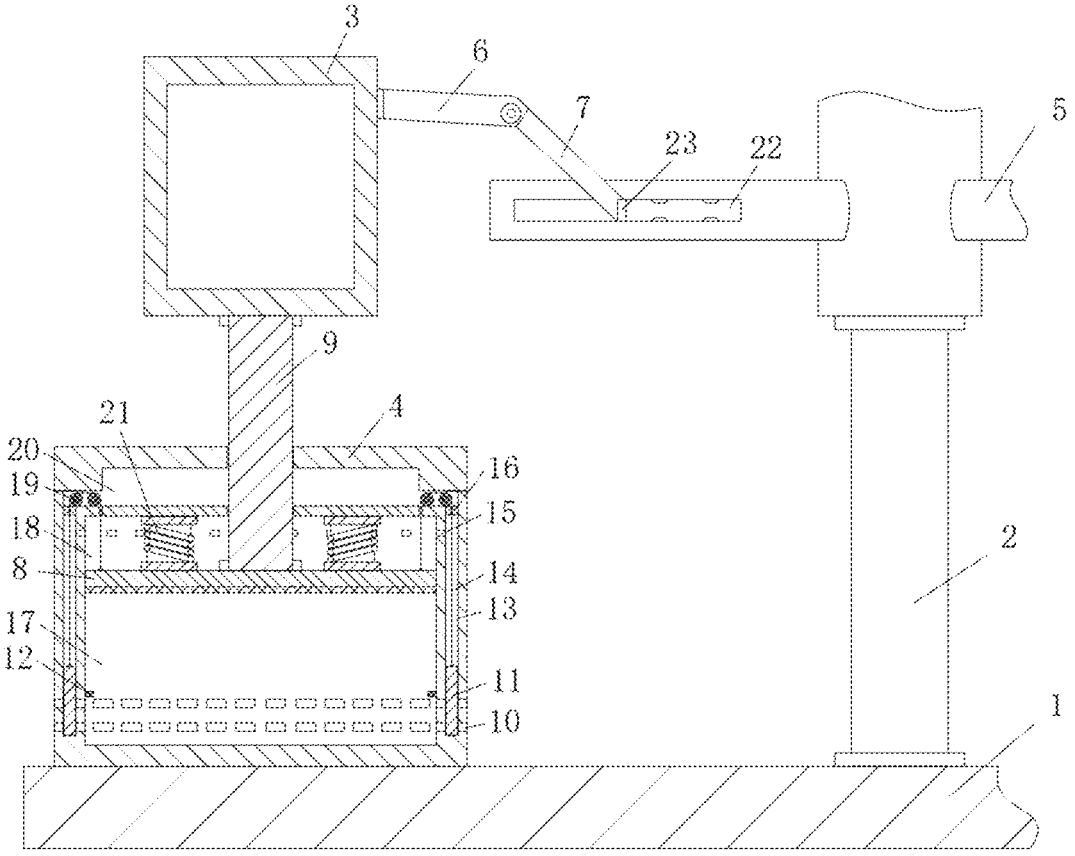
FIG. 6 is a schematic diagram showing a state when the buoy of the anti-rolling damping device according to the present disclosure floats with waves.
Figure 7:
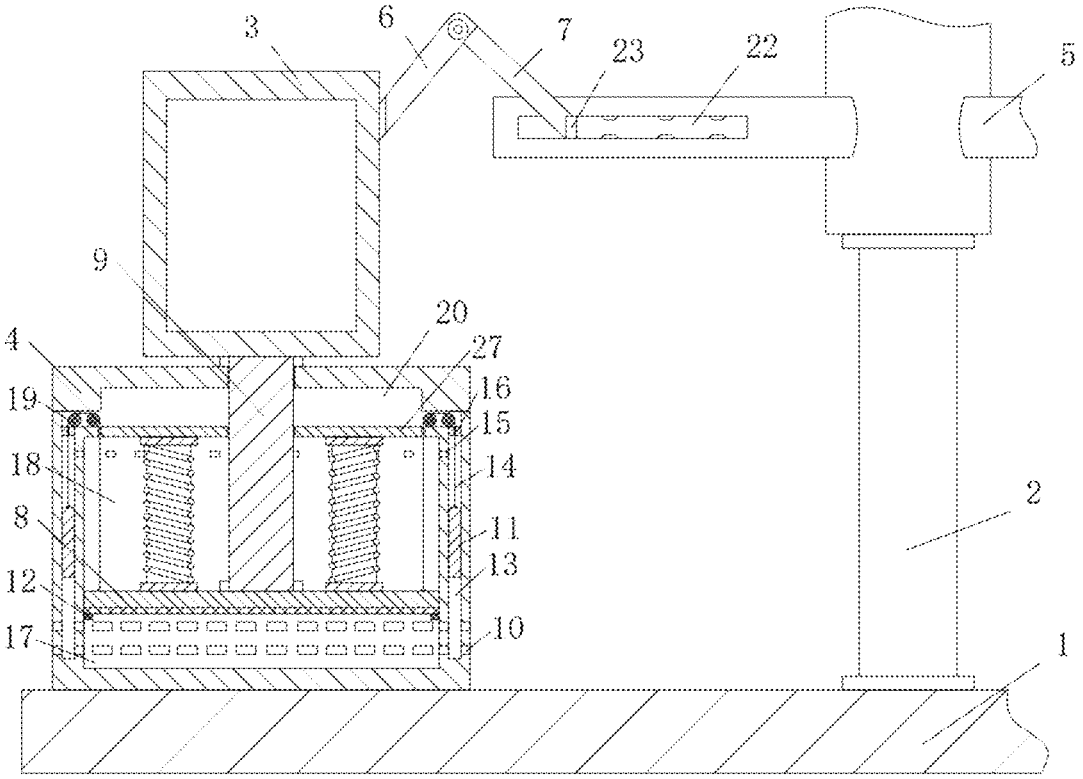
FIG. 7 is a schematic diagram showing a state when the buoy of the anti-rolling damping device according to the present disclosure sinks with the waves.

As shown in FIG. 3, lower ends of the buoys 3 are connected with an upper surface of the support plate 1 through a damping assembly, and the damping assembly includes a piston cylinder 4 fixedly arranged on the upper end face of the support plate 1, a piston plate 8 is slidably arranged in the piston cylinder 4, a piston rod 9 is fixedly arranged at one end of the piston plate 8 far from the support plate 1, and the piston rod 9 extends out of the top of the piston cylinder 4, and is fixedly connected with the buoys 3, and a plurality of first through holes 10 are arranged on a side wall of the piston cylinder 4 near a lower part. When the sea surface is calm, as shown in FIG. 5, the support plate 1 floats in the sea in a static state, the buoys 3 float on the sea surface, and the piston plate 8 is above the first through holes 10. By arranging the piston cylinder 4, the piston plate 8 and the first through holes 10, under the action of wave energy, the buoys 3 sink with the waves, and the piston plate 8 slides downward in the piston cylinder 4, so that the water in the piston cylinder 4 is discharged through the plurality of small first through holes 10 small in size, and resistance of the piston plate 8 sliding downward in the piston cylinder 4 is increased, that is, the buoys 3 are prevented from sinking with the wave energy, and the sinking amplitude of the buoys 3 is reduced, thereby reducing the downward swing amplitude of the buoys 3.

Further, a sliding plate 11 is arranged on a side wall of the piston cylinder 4 along a vertical direction, and the sliding plate 11 is capable of sliding up and down on the side wall of the piston cylinder 4; an upper end of the sliding plate 11 is provided with a steel wire 14 or a steel rope, and another end of the steel wire 14 is connected with the piston plate 8 by being arranged above the piston plate 8 and above a slider 23. When the sea surface is calm, the sliding plate 11 is located above the first through holes 10. When the sliding plate 11 moves downward, the first through holes 10 are capable of being blocked, thus preventing the water outside the piston cylinder 4 from entering the piston cylinder 4, that is to say, the counterweight of the piston cylinder 4 is increased, thereby reducing the swing amplitude of the buoys 3. The buoys 3 float with the waves, the piston plate 8 slides upward in the piston cylinder 4, the sliding plate 11 slides downward to cover the first through holes 10 due to its own weight, and water is stored below the piston plate 8 and in the piston cylinder 4, thus increasing the weight of the damping assembly and reducing the upward swing amplitude of the buoys 3.

Specifically, the sliding plate 11 is capable of being arranged on the side wall of the piston cylinder 4 in such a way: the side wall of the piston cylinder 4 is provided with a second through hole 13 with a shape of "⌈" along a height direction, a lower end of the second through hole 13 passes through the first through holes 10, that is, the second through hole 13 and the first through holes 10 are vertically arranged on the side wall of the piston cylinder 4, and water in the outside enters the bottom of the piston cylinder 4 through a first through hole 10, the second through hole 13 and another first through hole 10 in turn. The sliding plate 11 is slidably arranged in the second through hole 13, and a cross-sectional shape of the sliding plate 11 corresponds to a cross-sectional shape of the second through hole 13, that is, in the first through holes 10, water at the bottom of the sliding plate 11 does not enter the top of the sliding plate 11. The steel wire 14 is connected with an upper end face of the piston plate 8 through an upper transverse hole of the second through hole 13. When the sliding plate 11 slides downward in the second through hole 13, the piston plate 8 slides upward in the piston cylinder 4 due to the traction of the steel wire 14, so that the sliding plate 11 blocks the first through holes 10 and increases the counterweight of the piston cylinder 4. When the piston plate 8 slides downward in the piston cylinder 4, due to the traction of the steel wire 14, the sliding plate 11 slides upward in the second through hole 13, opening the first through holes 10 and discharging the water in the piston cylinder 4.

Further, a fixed plate 27 is arranged in the piston cylinder 4 and above the piston plate 8, a first cavity 17 is formed below the piston plate 8 at a bottom of the piston cylinder 4, a second cavity 18 is formed above the piston plate 8 and below the fixed plate 27, and a third cavity 20 is formed above the fixed plate 27 and at the top of the piston cylinder 4. An open end at a top of the second through hole 13 is communicated with the third cavity 20, and a pulley 19 is fixedly arranged in the upper transverse hole of the second through hole 13. The steel wire 14 passes through the pulley 19 and passes through the fixed plate 27 to be connected with an upper end face of the piston plate 8.

Further, a telescopic rod 28 is arranged in the piston cylinder 4 and between a lower end of the fixed plate 27 and an upper end of the piston plate 8, and a first spring 21 is arranged at a periphery of the telescopic rod 28. By arranging the telescopic rod 28, the up-and-down motion amplitude of the piston plate 8 in the piston cylinder 4 is controlled. By arranging the first spring 21, when the buoys 3 rise with the waves, the piston plate 8 presses the first spring 21, reducing the rising amplitude of the buoys 3.

Further, limit blocks 12 are arranged on an inner side wall of the piston plate 8, at upper ends of the first through holes 10 and below the piston plate 8. By setting the limit blocks 12, the piston plate 8 is restricted from falling below the first through holes 10, and water is prevented from entering the second cavity 18.

In a better technical scheme, a stopper 16 is arranged in a vertical hole of the second through hole 13 with a shape of "⌈" near the transverse hole to separate the vertical hole and the transverse hole of the second through hole 13, and at this time, the steel wire 14 passes through the vertical hole, the stopper 16 and the transverse hole in turn and is fixedly connected with the upper end face of the piston plate 8. A plurality of third through holes 15 are arranged on a side wall close to the piston rod 9 and below the stopper 16 in the vertical hole of the second through hole 13, and the plurality of third through holes 15 are used for communicating the second cavity 18 with the vertical hole of the second through hole 13. Hydraulic oil is filled in the second cavity 18 and the vertical hole of the second through hole 13. When the buoys 3 move upward with the waves, the piston rod 9 drives the piston plate 8 to move upward in the piston cylinder 4, and the hydraulic oil in the second cavity 18 is squeezed into the vertical hole of the second through hole 13 through the third through hole 15. Because of the small volume of the third through hole 15, the flow resistance of the hydraulic oil is increased. At the same time, when the slider 23 moves to the bottom inside the second through hole 13, and because the telescopic rod 28 has been shortened to the shortest position, due to the pushing action of hydraulic oil, at this time, the upward force of the buoys 3 driving the piston rod 9 is converted into the force of the slider 23 pressing the piston cylinder 4 downward, the support plate 1 is pressed downwards to prevent the fixed frame 2 on the support plate 1 from moving upwards, and the top of the piston cylinder 4 generates downward force on the piston plate 8, reducing the upward movement amplitude of the buoys 3 with the waves.

Further, when the piston plate 8 moves upward, in order to increase the resistance of the piston plate 8 to move upward by using the surface tension of water on the lower surface of the piston plate 8, the lower end surface of the piston plate 8 is made of a material having a large surface tension with water, such as glass.

Further, the fixed frame 2 is provided with a third connecting rod 5 corresponding to the buoys 3; the buoys 3 are hinged with a first connecting rod 6, and another end of the first connecting rod 6 is hinged with a second connecting rod 7, and another end of the second connecting rod 7 is slidably arranged on the third connecting rod 5 along the length direction of the third connecting rod 5. When the buoys 3 move up and down, one end of the second connecting rod 7 slides on the third connecting rod 5.

Further, an embodiment of the sliding connection between one end of the second connecting rod 7 and the third connecting rod 5 is as follows: a chute 22 with a shape of "T" is arranged on an outer side wall of the third connecting rod 5 along a length direction, and a corresponding slider 23 with a shape of "T" is slidably arranged in the chute 22, and the slider 23 is hinged with the second connecting rod 7.

Figure 8:
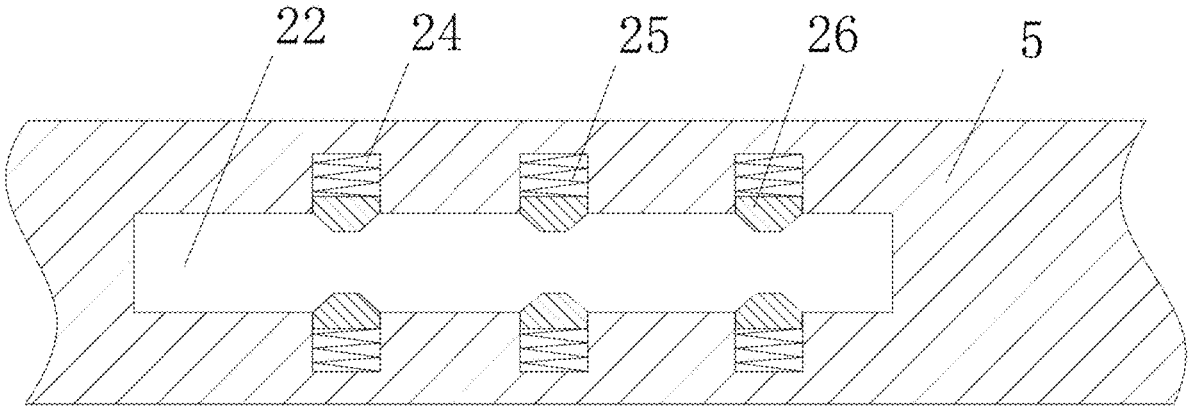
FIG. 8 is a schematic cross-sectional view of a section C-C in FIG. 1.

Further, as shown in FIG. 8, an inner side wall of the chute 22 is provided with a groove 24, a second spring 25 is arranged in the groove 24, and a stop block 26 is arranged at another end of the second spring 25, and an end of the stop block 26 far away from the second spring 25 is a quadrangular prism table. When the buoys 3 move up or down with the waves, the slider 23 slides left and right in the chute 22, and the slider 23 squeezes the stop block 26 and compresses the second spring 25, thus increasing the resistance of the slider 23 to slide left and right in the chute 22, and further reducing the amplitude of the up-down movement of the buoys 3.

The above-mentioned embodiments only describe the optional mode of the disclosure, and do not limit the scope of the disclosure. Under the premise of not departing from the design spirit of the disclosure, all kinds of deformation, variation, modification and substitution of the technical scheme of the disclosure made by ordinary technicians in the field shall fall within the protection scope determined by the claims of the disclosure.

What is claimed is:

1. An anti-rolling damping device for floating wind turbines, comprising a support plate (1) and buoys (3) arranged above the support plate (1), where the buoys (3) are movably connected with a fixed frame (2) for fixing a wind turbine, and a bottom of the fixed frame (2) is fixedly arranged on the support plate (1); lower ends of the buoys (3) are connected with an upper surface of the support plate (1) through a damping assembly, and the damping assembly includes a piston cylinder (4) fixedly arranged on the support plate (1), a piston plate (8) is slidably arranged in the piston cylinder (4), a piston rod (9) is arranged at one end of the piston plate (8) far from the support plate (1), and the piston rod (9) extends out of the piston cylinder (4), and is fixedly connected with the buoys (3), and a plurality of first through holes (10) are arranged on a side wall of the piston cylinder (4) near a lower part; the buoys (3) sink with waves, and the piston plate (8) slides downward in the piston cylinder (4), so that the water in the piston cylinder (4) is discharged through the plurality of first through holes (10), and resistance of the piston plate (8) sliding downward is increased.

2. The anti-rolling damping device for the floating wind turbines according to claim 1, wherein a sliding plate (11) is arranged on a side wall of the piston cylinder (4) along a vertical direction, an upper end of the sliding plate (11) is provided with a steel wire (14), and another end of the steel wire (14) is connected with the piston plate (8) by being arranged above the piston plate (8) and above the sliding plate (11); the buoys (3) float with the waves, the piston plate (8) slides upward in the piston cylinder (4), the sliding plate (11) slides downward to cover the first through holes (10), and water is stored below the piston plate (8) and in the piston cylinder (4), thus increasing the weight of the damping assembly.

3. The anti-rolling damping device for the floating wind turbines according to claim 2, wherein the side wall of the piston cylinder (4) is provided with a second through hole (13) with a ⌈-shape along a height direction, a lower end of the second through hole (13) passes through the first through holes (10), the sliding plate (11) is slidably arranged in the second through hole (13), the steel wire (14) is connected with an upper end face of the piston plate (8) through an upper transverse hole of the second through hole (13).

4. The anti-rolling damping device for the floating wind turbines according to claim 3, wherein a fixed plate (27) is arranged in the piston cylinder (4) and above the piston plate (8), a first cavity (17) is formed below the piston plate (8) at a bottom of the piston cylinder (4), a second cavity (18) is formed above the piston plate (8) and below the fixed plate (27), and a third cavity (20) is formed above the fixed plate (27) and at the top of the piston cylinder (4); an open end at a top of the second through hole (13) is communicated with the third cavity (20), and a pulley (19) is fixedly arranged in the upper transverse hole of the second through hole (13); the steel wire (14) passes through the pulley (19) and passes through the fixed plate (27) to be connected with an upper end face of the piston plate (8).

5. The anti-rolling damping device for the floating wind turbines according to claim 4, wherein a telescopic rod (28) is arranged in the piston cylinder (4) and between a lower end of the fixed plate (27) and an upper end of the piston plate (8), and a first spring (21) is arranged at a periphery of the telescopic rod (28).

6. The anti-rolling damping device for the floating wind turbines according to claim 5, wherein limit blocks (12) are arranged on an inner side wall of the piston plate (8), at upper ends of the first through holes (10) and below the piston plate (8).

7. The anti-rolling damping device for the floating wind turbines according to claim 6, wherein a stopper (16) is arranged in a vertical hole of the second through hole (13) near the transverse hole; the steel wire (14) passes through the vertical hole, the stopper (16) and the transverse hole in turn and is fixedly connected with the upper end face of the piston plate (8); a plurality of third through holes (15) are arranged on a side wall close to the piston rod (9) and below the stopper (16) in the vertical hole of the second through hole (13), and the plurality of third through holes (15) are used for communicating the second cavity (18) with the vertical hole of the second through hole (13); hydraulic oil is filled in the second cavity (18) and the vertical hole of the second through hole (13).

8. The anti-rolling damping device for the floating wind turbines according to claim 7, wherein the fixed frame (2) is provided with a third connecting rod (5) corresponding to the buoys (3); the buoys (3) are hinged with a first connecting rod (6), and another end of the first connecting rod (6) is hinged with a second connecting rod (7), and another end of the second connecting rod (7) is slidably arranged on the third connecting rod (5) along the length direction of the third connecting rod (5).

9. The anti-rolling damping device for the floating wind turbines according to claim 8, wherein a chute (22) with a T-shape is arranged on an outer side wall of the third connecting rod (5) along a length direction, and a corresponding slider (23) with a T-shape is slidably arranged in the chute (22), and the slider (23) is hinged with the second connecting rod (7).

10. The anti-rolling damping device for the floating wind turbines according to claim 9, wherein a groove (24) is arranged on an inner side wall of the chute (22), a second spring (25) is arranged in the groove (24), and another end of the second spring (25) is provided with a stop block (26), and an end of the stop block (26) far away from the second spring (25) is a quadrangular prism table.

* * * * *